US009359181B2

(12) United States Patent
Berger et al.

(10) Patent No.: US 9,359,181 B2
(45) Date of Patent: Jun. 7, 2016

(54) FILLING METHOD AND DEVICE

(71) Applicant: SIG TECHNOLOGY AG, Neuhausen am Rheinfall (CH)

(72) Inventors: Jörg Berger, Jülich (DE); Werner Seiche, Bergheim (DE); Toralf Grützner, Dresden (DE); Dirk Auer, Meerbusch (DE)

(73) Assignee: SIG TECHNOLOGY AG, Neuhausen am Rheinfall (CH)

( * ) Notice: Subject to any disclaimer, the term of this patent is extended or adjusted under 35 U.S.C. 154(b) by 273 days.

(21) Appl. No.: 14/052,248

(22) Filed: Oct. 11, 2013

(65) Prior Publication Data

US 2014/0034188 A1 Feb. 6, 2014

Related U.S. Application Data

(63) Continuation-in-part of application No. 13/121,741, filed as application No. PCT/DE2009/001026 on Jul. 20, 2009, now abandoned.

(30) Foreign Application Priority Data

Sep. 30, 2008 (DE) ..... 10 2008 049 550

(51) Int. Cl.

| | |
|---|---|
| ***B65B 31/00*** | (2006.01) |
| ***B67C 3/26*** | (2006.01) |
| ***B65B 3/22*** | (2006.01) |
| ***B65B 39/00*** | (2006.01) |
| ***B65B 39/04*** | (2006.01) |
| ***B65B 39/12*** | (2006.01) |
| ***B65B 55/02*** | (2006.01) |
| ***B65B 3/04*** | (2006.01) |

(52) U.S. Cl.

CPC ... *B67C 3/26* (2013.01); *B65B 3/04* (2013.01); *B65B 3/22* (2013.01); *B65B 39/007* (2013.01); *B65B 39/04* (2013.01); *B65B 39/12* (2013.01); *B65B 55/027* (2013.01); *B67C 2003/268* (2013.01); *B67C 2003/2677* (2013.01)

(58) Field of Classification Search

CPC ..... B65B 3/22; B67C 2003/2671; B67C 2003/2674; B67C 2003/2677; B67C 2003/268

USPC ..... 141/1, 7, 59, 286, 374; 222/564, 526

See application file for complete search history.

(56) References Cited

U.S. PATENT DOCUMENTS

| | | | | |
|---|---|---|---|---|
| 3,460,590 | A * | 8/1969 | Robbins | B67C 3/16 141/286 |
| 4,711,277 | A | 12/1987 | Clish | |
| 5,141,035 | A | 8/1992 | Nish et al. | |
| 5,309,961 | A | 5/1994 | Franke et al. | |

(Continued)

FOREIGN PATENT DOCUMENTS

| | | | |
|---|---|---|---|
| EP | 0099582 | A | 2/1984 |

*Primary Examiner* — Jason K Niesz

(74) *Attorney, Agent, or Firm* — Lucas & Mercanti, LLP; Klaus P. Stoffel

(57) ABSTRACT

A method and device for filling containers with a liquid product. The product is fed to the container by a filling valve and a filling nozzle. The product emerging from the filling nozzle is fed to a directing element. The directing element has a geometrical configuration such that an edge of the directing element runs along at a small distance from the inside walls of the container.

22 Claims, 4 Drawing Sheets

(56) References Cited

U.S. PATENT DOCUMENTS 5,758,698 A * 6/1998 Kaneko ..... B65B 39/004 141/148
5,819,821 A 10/1998 Giacomelli
5,865,217 A 2/1999 Giacomelli
6,698,473 B2 3/2004 Decarne
7,278,454 B2 10/2007 Younkle
2003/0150517 A1 * 8/2003 Decarne ..... B67C 3/26 141/286

* cited by examiner

FILLING METHOD AND DEVICE

CROSS-REFERENCE TO RELATED APPLICATIONS

The present application is a Continuation-In-Part of U.S. patent application Ser. No. 13/121,741, filed Apr. 23, 2012, which is a 371 of International application PCT/DE2009/001026 filed Jul. 20, 2009, which claims priority of DE 10 2008 049 550.6, filed Sep. 30, 2008, the priority of these applications is hereby claimed and these applications are incorporated herein by reference.

BACKGROUND OF THE INVENTION

The invention pertains to a method for filling containers with liquid, which is supplied to the container through a filling valve and a filling nozzle.

The invention also pertains to a device for filling containers with a liquid, the device comprising at least one filling valve and at least one filling nozzle.

Many different filling devices and methods of this type for filling cartons and bottles, for example, are known. An essential goal of implementing a filling method is to fill the container both rapidly and reliably. So that a container can be filled rapidly, it is helpful to avoid or to reduce as much as possible the formation of foam during the filling operation. A problem with the filling of containers with a non-circular cross-sectional shape results from the fact that the distance between the filling nozzle, which is centrally located in most cases, and the inside walls differs, depending on the solid angle in question, and this promotes the formation of foam.

SUMMARY OF THE INVENTION

The goal of the present invention is to improve a method of the type indicated above in such a way that containers with non-circular cross sections can be filled more effectively.

This goal is achieved according to the invention in that the liquid emerging from the filling nozzle is sent to a guide element, which is provided with a geometric shape such that the edge of the guide element positioned inside the container is arranged so that it extends along and a short distance away from the container wall.

An additional goal of the present invention is to design a device of the type indicated above in such a way that containers with a non-circular cross section can be filled more effectively.

This goal is achieved according to the invention in that, downstream of the filling nozzle, a guide element is arranged, which comprises a design such that the edge of the guide element positioned inside the container is arranged so that it extends along and a short distance away from an inside wall of the container to be filled.

The inventive method and the inventive device are especially suitable for filling beverage cartons. During the filling process, these types of beverage cartons are opened at their vertically upward-facing end and are sealed only after the completion of the filling operation. It is therefore easy to introduce the inventive guide element into the upper end of the interior of the container.

By designing the geometry of the guide element so that the entire edge of the guide element extends along and a short distance away from the inside walls of the container, the liquid flowing along the guide element is directed against the inside walls of the container and can then flow uniformly down these walls. The design of the guide element, furthermore, ensures the uniform distribution of the liquid, so that equal volume flow rates are supplied to essentially all areas of the inside periphery of the container. As a result, the container can be filled more rapidly and more uniformly without the formation of significant amounts of foam.

The uniform distribution of the liquid over the entire area of the inside surface of the container leads to a significant reduction in the flow rate of the liquid. Because the liquid slides down uniformly along the inside walls of the container, the speed at which the liquid hits the bottom of the container and, as the filling operation proceeds, the speed at which it hits the surface of the liquid already in the container, is reduced, as a result of which the formation of foam is again decreased.

The inventive guide element can be used in stationary filling machines operating in cycles and also in filling machines with rotating filling wheels.

The use of the guide element as a diffuser promotes the uniform feed of the liquid to the interior of the container.

That the liquid is guided by the guide element toward the wall of the container at an angle to the horizontal helps the liquid to run smoothly down the inside wall.

Selecting the distance in such a way that the liquid flowing over the edge of the guide element reaches the inside surface of the side walls of the container promotes the continuous transfer of the liquid from the guide element to the inside surface of the walls of the container.

A distance of no more than 15 mm is selected as an effective value.

According to a preferred embodiment, the container is filled with liquid under aseptic conditions.

A typical filling operation of non-circular containers involves the filling of a container made of paperboard material.

An additional way to ensure a uniform filling operation is to use deflector surfaces on the guides to keep the liquid away from the edges of the container, as a result of which the air displaced from the interior of the container can escape upwards along the container edges.

It is especially effective for the air deflector elements to be positioned in the area of the corners of the guide element.

It is also possible to ensure rapid venting during the filling operation by the use of a hollow-bore valve shaft. In particular, it is effective for the interior of the package to be flushed with inert gas, for example, nitrogen, through this valve shaft before the filling operation in order to decrease the amount of oxygen in the headspace.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
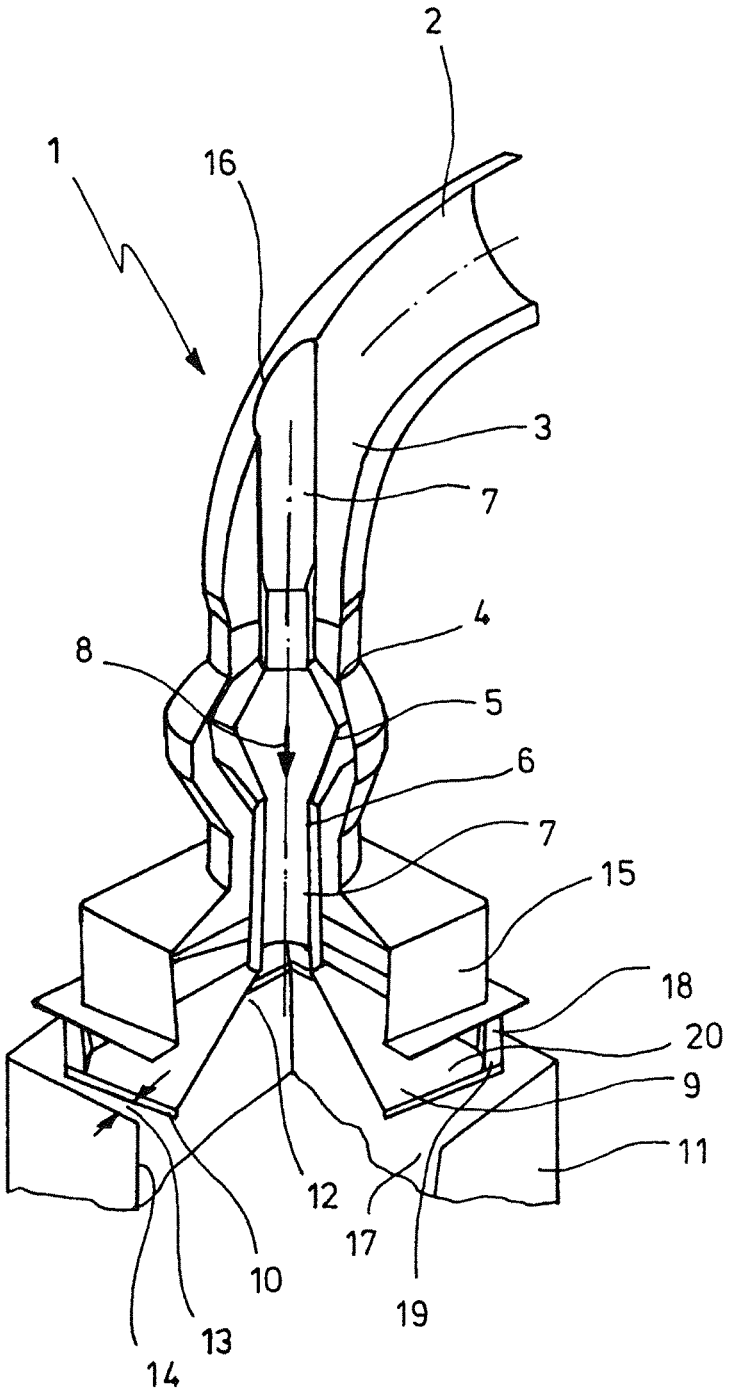
FIG. 1 shows a partially cut-away schematic diagram of a filling device with the associated part of the container to be filled.

FIG. 1 shows a partial cross-sectional schematic diagram of a filling device 1. The filling device 1 comprises a connecting line 2 for connecting the device to a supply tank (not shown) holding the liquid with which the container is to be filled. Typically, the connecting line 2 is connected by way of an elbow 3 to a valve seat 4, which is provided to receive a filling valve (not shown). The valve seat 4 is connected to a nozzle 6 by a valve elbow 5. A shaft 7, which is usually hollow and thus allows gas exchange to occur in the interior of the package before and during the filling operation, extends longitudinally through the nozzle 6.

A guide element 9 is arranged underneath the filling nozzle 6 with respect to the flow direction 8. This guide element comprises an edge 10. The geometric shape of the guide element 9 and in particular the course of the edge 10 are adapted to the cross section of the container 11 to be filled, only part of which is shown in FIG. 1.

Proceeding from the central area 12 of the guide element 9 facing the filling nozzle 6, the guide element 9 extends toward the edge 10 with a gradient to the vertical and, in the area of the edge 10, it remains a certain distance 13 away from the inside surface 14 of the side walls of the container 11.

The filling nozzle 6 and the guide element 9 are covered by a hood 15, so that the container can be filled with the liquid under aseptic conditions.

To make it possible for air to escape from the interior space 17 of the container 11 to be filled as the level of the liquid rises, the guide element 9 comprises one or more air discharge elements 18. The air discharge elements 18 are preferably arranged at the corners 19 of the guide element 9. In the area where they face the central area 12, the air discharge elements 18 are provided with deflector surfaces 20.

Figure 2:
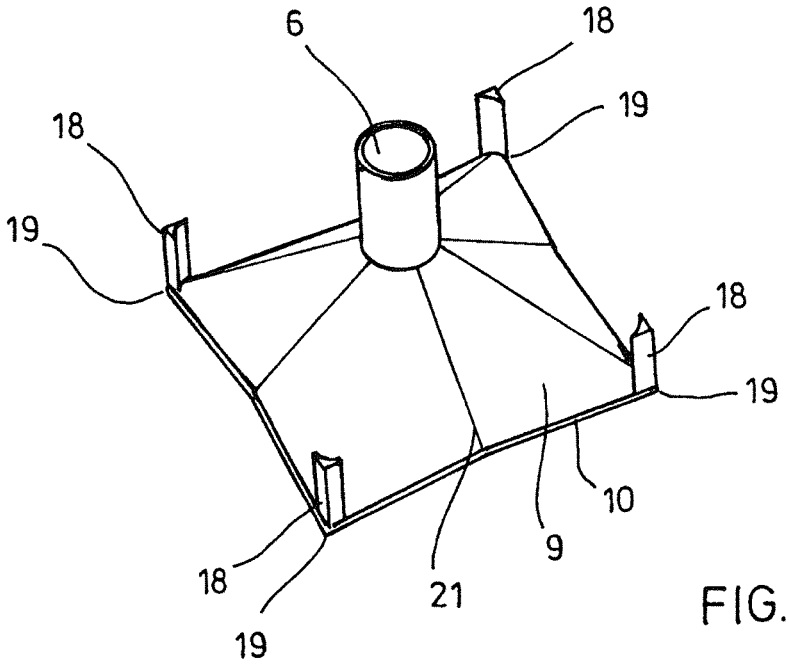
FIG. 2 shows a perspective view of the guide element with additional air deflector elements.

The air discharge elements 18 can be designed as profiles open toward the inside surface 14 of the container 12. It is also possible to use hollow profiles open in the vertical direction. FIG. 2 shows a perspective view of the guide element 9 and of the filling nozzle 6 arranged above the guide element 9. In the exemplary embodiment illustrated here, the guide element 9 is designed for the filling of containers 11 with an essentially square cross section. The guide element 9 comprises a surface profile 21, which promotes the uniform feed of liquid to the inside surfaces 14 of the container 11. In the area of each corner 19 of the guide element 9, an air discharge element 18 is arranged in such a way that it rises like a post above the edge 10.

Figure 3:
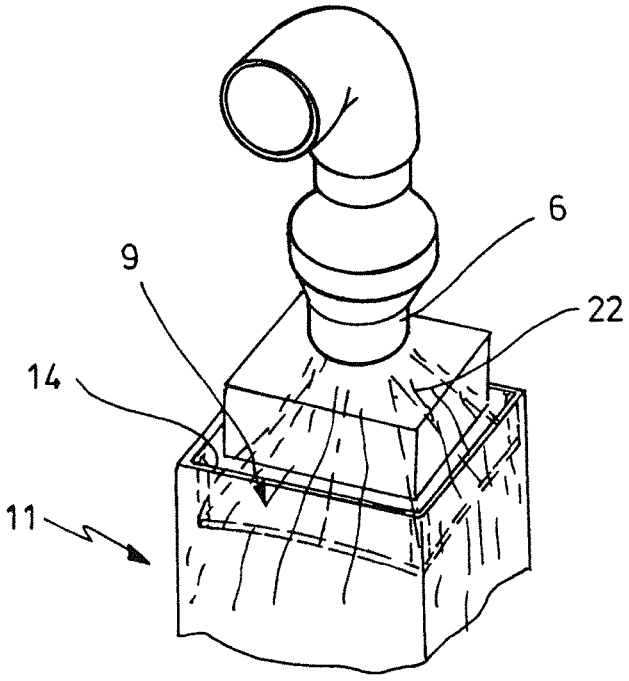
FIG. 3 shows a perspective view illustrating the flow of liquid over the guide element to the inside surface of the container.
Figure 4:
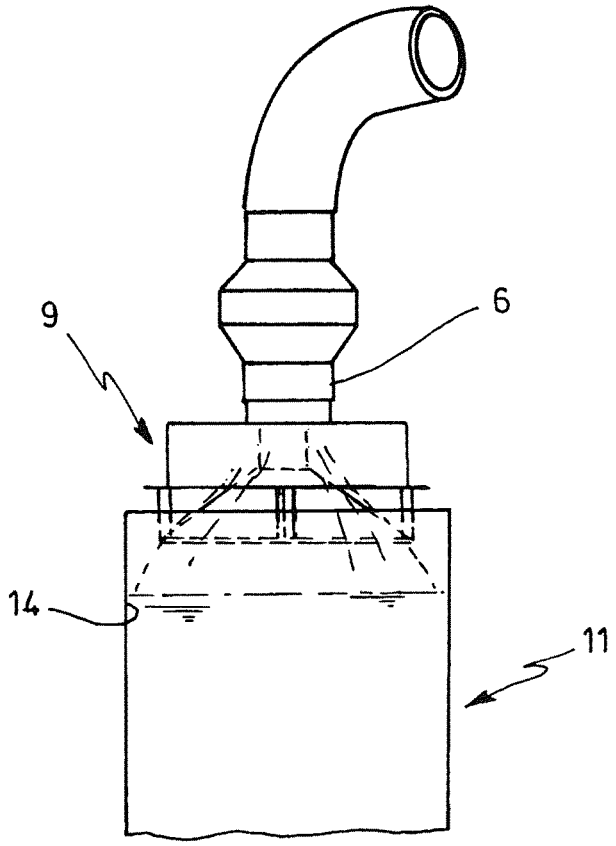
FIG. 4 shows a side view of the arrangement according to FIG. 1.

FIG. 3 shows how a filling operation is carried out. The liquid 22 emerges from the filling nozzle 6 and strikes the guide element 9. As a result of the guide element 9, the liquid 22 is guided uniformly toward the inside surfaces 14 of the container 11 and can then run uniformly down these inside surfaces 14. FIG. 4 shows a side view of the filling operation according to FIG. 3. Here, too, the extremely uniform flow of the liquid 22 down the inside surfaces 14 can be seen.

Figure 1A:
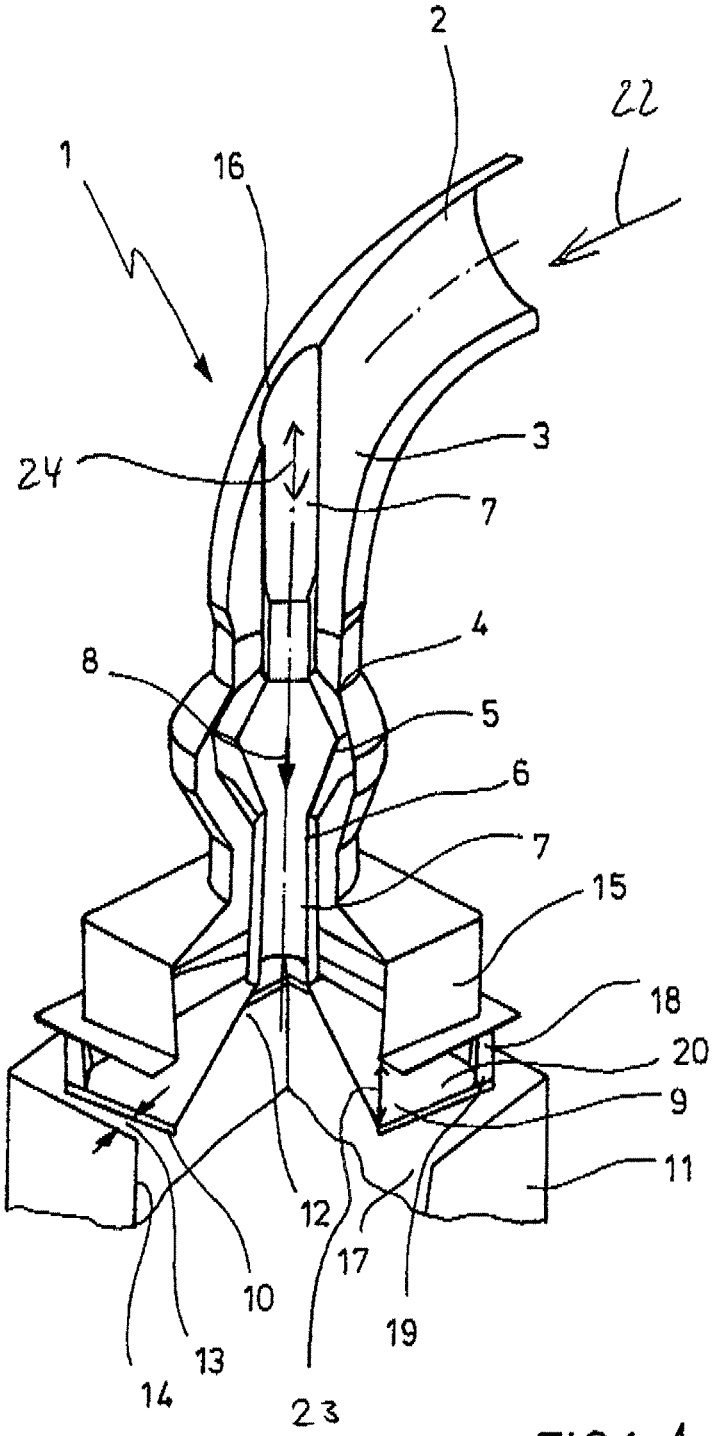
FIG. 1A shows a view similar to FIG. 1 with the guide element adjustable to the hood.

With reference to FIGS. 1 and 1A, the venting function will now be further explained. The venting function of the filling device is realized by a cooperation of the edge of the hood 15 and the edge of the guide element 9. The guide element 9 is positionable in a vertical direction relative to the hood 15. The positioning can occur by a vertical change in position of the shaft 7. The shaft 7 projects out of the side wall of the elbow 3.

The lower end of the shaft 7 is connected with the guide element 9 and at the other end the hood 15 is fixedly connected to the elbow 3. Because of this connection, a positioning of the shaft 7 leads to a change in the spacing between the guide element 9 and the edge of the hood 15. In this way it is possible to alter the size of the outflow area.

FIG. 1 shows that a spacing is realized between the guide element 9 and the hood 15 that permits an outflow of the filling liquid. This spacing is adjustable and the guide element is positionable with the help of the shaft 7.

FIG. 1A shows, in combination with FIG. 1, further details of the construction of the filling device 1, as well as the carrying out of the filling procedure. The liquid 22 to be filled into the container 11 is conveyed along the connecting pipe 2 through the elbow 3 into the region of the nozzle 6. The liquid 22 flows along the shaft 7 up to the region of the hood 15. An interior space of the hood 15 is bordered by the guide element 9 in the direction of the container 11 to be filled. Between the edge 10 of the guide element 9 and the hood 15 there extends a spacing 23. By adjusting the shaft 7 in an adjusting direction 24 the size of the spacing 23 can be changed.

The shaft 7 extends out of a wall of the elbow 3 for assisting the positioning of the shaft 7 and therewith the positioning of the guide element 9 relative to the hood 15. A suitable adjusting element can thus be positioned externally from the elbow 3 and can be connected with the shaft 7.

By setting the spacing 23, the size of the outflow area for the filling liquid 22 which is bordered on the one hand by the guide element 9 and on the other hand by the hood 15, can be changed. The size of this outflow area determines the flow resistance for the filling liquid 22 and therewith the filling material volume exiting the filling device, alternatively the filling speed. In this way an adjustable valve function is realized.

FIG. 3 illustrates the flow of the liquid 22 into the hood 15 and through the interior of the hood 15 along the guide element 9 into the interior of the container 11 to be filled. Thus, FIG. 3 particularly clearly shows how the volume of the liquid 22 is provided by the realized valve function and the liquid 22 is conducted directly to the region of the inner surfaces of the walls of the container.

While specific embodiments of the invention have been shown and described in detail to illustrate the inventive principles, it will be understood that the invention may be embodied otherwise without departing from such principles.

We claim:

1. A method for filling containers with liquid, which is supplied to the container through a filling valve and a filling nozzle, the method comprising the steps of: providing a shaft that extends in a longitudinal direction of the filling nozzle; connecting a guide element having a geometric shape to the shaft so that an edge of the guide element positioned inside the container extends along and a certain distance away from walls of the container; covering the filling nozzle and the guide element with a hood so that the guide element is at a distance from the hood; and sending liquid emerging from the filling nozzle to the guide element, wherein the guide element is a diffuser having a non-round shape, including guiding the liquid by the guide element at an angle to vertical against the wall of the container, wherein the guide element extends from a central area facing the filling nozzle toward the edge at an angle to vertical.

2. The method according to claim 1, including selecting the distance so that liquid flowing over the edge of the guide element reaches an area of an inside surface of the side wall of the container.

3. The method according to claim 2, including selecting the distance to be no more than 15 mm.

4. The method according to claim 1, including filling the container with liquid under aseptic conditions.

5. The method according to claim 1, wherein the container is made of paperboard material.

6. The method according to claim 1, including carrying away air which has been displaced from an interior of the container by the filling operation.

7. The method according to claim 6, including positioning air deflector elements in the area of corners of the guide element.

8. The method according to claim 1, including positioning the guide element in an adjustment direction.

9. The method according to claim 1, including adjusting a distance between the guide element and the hood.

10. The method according to claim 8, including adjusting the guide element by positioning the shaft that permits gas exchange in the container and extends through the nozzle.

11. The method according to claim 10, wherein the shaft extends out of a connecting line that supplies the liquid.

12. A device for filling containers with liquid, the device comprising: at least one filling valve; at least one filling nozzle; a shaft extending in a longitudinal direction of the filling nozzle; a guide element connected to the shaft and arranged downstream, with respect to a flow direction, of the filling nozzle, the guide element being configured so that an edge of the element is positioned inside the container and is arrangeable along and a certain distance away from an inside surface of a side wall of the container to be filled wherein the guide element is a diffuser having a non-round shape, wherein the guide element proceeding from a central area facing the filling nozzle extends toward the edge at an angle to vertical; and a hood that covers the filling nozzle and the guide element, wherein the guide element is arranged so that there is a spacing between the guide element and the hood.

13. The device according to claim 12, wherein the distance of the edge of the element from the inside surface of the side wall of the container is sufficient to transfer the liquid from the guide element to the inside surface of the container.

14. The device according to claim 13, wherein the distance is no more than 15 mm.

15. The device according to claim 12, wherein the device is constructed so as to fill containers under aseptic conditions.

16. The device according to claim 12, wherein the device is constructed so as to fill containers made of paperboard material.

17. The device according to claim 12, wherein the guide element comprises at least one air deflector element.

18. The device according to claim 17, wherein the air deflector element is arranged in an area of a corner of the guide element.

19. The device according to claim 12, wherein the guide element is positionable in an adjustment direction.

20. The device according to claim 19, wherein the spacing between the guide element and the hood is adjustable.

21. The device according to claim 19, further comprising a shaft that extends longitudinally through the nozzle, wherein the guide element is adjusted by positioning the shaft.

22. The device according to claim 21, wherein the shaft extends out of a connecting line that supplies the liquid, wherein the shaft is coupled to an adjusting element.

* * * * *